US009959812B2

(12) United States Patent
Hwang et al.

(10) Patent No.: US 9,959,812 B2
(45) Date of Patent: May 1, 2018

(54) METHOD OF COMPENSATING AMOLED POWER SUPPLY VOLTAGE DROP

(71) Applicant: Shenzhen China Star Optoelectronics Technology Co., Ltd., Shenzhen, Guangdong (CN)

(72) Inventors: Taijiun Hwang, Guangdong (CN); Jihshiang Lee, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 586 days.

(21) Appl. No.: 14/423,122

(22) PCT Filed: Feb. 6, 2015

(86) PCT No.: PCT/CN2015/072365

§ 371 (c)(1),
(2) Date: Feb. 21, 2015

(87) PCT Pub. No.: WO2016/074352

PCT Pub. Date: May 19, 2016

(65) Prior Publication Data

US 2016/0343304 A1 Nov. 24, 2016

(30) Foreign Application Priority Data

Nov. 14, 2014 (CN) ..... 2014 1 0649921

(51) Int. Cl.
*G09G 3/3258* (2016.01)
*G09G 3/3225* (2016.01)
*G09G 3/3291* (2016.01)

(52) U.S. Cl.
CPC ..... *G09G 3/3291* (2013.01); *G09G 3/3225* (2013.01); *G09G 3/3258* (2013.01);
(Continued)

(58) Field of Classification Search
CPC ..... G09G 2320/0223; G09G 3/3688; G09G 3/3648; G09G 2320/0233;
(Continued)

(56) References Cited

U.S. PATENT DOCUMENTS 8,416,234 B2 * 4/2013 Mizukoshi ..... G09G 3/3233 345/214
8,810,556 B2 * 8/2014 Lee ..... G09G 3/3233 345/204
(Continued)

OTHER PUBLICATIONS

International Preliminary Report on Patentability. PCT/CN2015/072365, dated May 16, 2017.*

*Primary Examiner* — Julie Anne Watko
(74) *Attorney, Agent, or Firm* — Andrew C. Cheng

(57) ABSTRACT

The present invention provides a method of compensating AMOLED power supply voltage drop, comprising: step 1, measuring a brightness value L of each light-emitting element line of a panel by starting from a COF end of the AMOLED; step 2, drawing a brightness variation curve of the each light-emitting element line caused by IR Drop according to the brightness value L of the each light-emitting element line measured in the step 1; step 3, calculating a voltage value for compensation of every two adjacent light-emitting elements from difference values between the brightnesses of every two adjacent light-emitting elements according to a ratio conversion between a brightness difference $\Delta L$ and a voltage difference $\Delta V$, i.e. $\Delta V=\alpha\cdot\Delta L$, wherein $\alpha$ is a scaling factor; step 4, making no compensation to a data voltage of the first light-emitting element line, and adding the first compensation value $\Delta V_1$ to a data voltage of the second light-emitting element line, and adding a sum $(\Delta V_1+\Delta V_2)$ of the first and the second compensation value to a data voltage of a third light-emitting element line and so on to the last light-emitting element line when a sequence
(Continued)

controller transmits data voltage signals for showing images. The method can solve the issue of uneven brightness caused by IR Drop in a large scale AMOLED display device.

9 Claims, 4 Drawing Sheets

(52) U.S. Cl.
CPC ..... *G09G 2300/043* (2013.01); *G09G 2320/0233* (2013.01); *G09G 2320/0285* (2013.01); *G09G 2320/0295* (2013.01); *G09G 2360/147* (2013.01)

(58) Field of Classification Search
CPC ..... G09G 2320/043; G09G 3/3677; G09G 2300/0819; G09G 2320/0285; G09G 3/3696; G09G 3/3611; G09G 2310/0205; G09G 2320/02; G09G 2320/029; G09G 3/3275; G09G 2300/0866; G09G 2320/0204; G09G 2320/0271; G09G 2320/0295; G09G 2360/16; G09G 3/3266; G09G 3/3426; G09G 2320/0693; G09G 3/3283; G09G 3/3291; G09G 3/3225; G09G 3/3208; G09G 3/32; G09G 3/30; G09G 3/3258; G09G 2300/043; G09G 2360/147; G09G 2360/148; G09G 2360/145; G09G 2360/14
See application file for complete search history.

(56) References Cited

U.S. PATENT DOCUMENTS 8,994,617 B2 * 3/2015 Chaji ..... G09G 3/006 345/690
2008/0204483 A1 * 8/2008 Abe ..... G09G 3/22 345/690
2012/0249514 A1 * 10/2012 Ahn ..... G09G 3/3233 345/212
2014/0307010 A1 * 10/2014 Han ..... G09G 3/3233 345/691
2016/0055799 A1 * 2/2016 Eom ..... G09G 3/3225 345/690
2016/0180815 A1 * 6/2016 Pyo ..... G09G 3/2022 345/213

* cited by examiner

METHOD OF COMPENSATING AMOLED POWER SUPPLY VOLTAGE DROP

FIELD OF THE INVENTION

The present invention relates to a display technology field, and more particularly to a method of compensating AMOLED power supply voltage drop.

BACKGROUND OF THE INVENTION

The Organic Light-Emitting Display (OLED) utilizes the phenomenon that the illumination due to the carrier injection and recombination under the electric field driving of organic semiconductor illuminating material. The illuminating principle is that the Indium Tin Oxide (ITO) transparent electrode and the metal electrode are respectively employed as the anode and the cathode of the Display. Under certain voltage driving, the Electron and the Hole are respectively rejected into the Electron and Hole Transporting Layers from the cathode and the anode. The Electron and the Hole respectively migrate from the Electron and Hole Transporting Layers to the Emitting layer and bump into each other in the Emitting layer to form an exciton to excite the emitting molecule. The latter can illuminate after the radiative relaxation.

The OLED possesses advantages of being thinner, lighter, active lighting (without a backlight source), no view angle concern, high resolution, high brightness, fast response, low power consumption, wide usage temperature range, strong anti-shock ability, low manufacture cost and possible flexible display.

The OLED can be categorized into two major types, which are the passive driving and the active driving, i.e. the direct addressing and the Thin Film Transistor (TFT) matrix addressing. The active driving is also called Active Matrix (AM) type. Each light-emitting element in the AMOLED is independently controlled by TFT addressing. The light-emitting element and the pixel structure comprising the TFT addressing circuit require the power supply signal line to load the direct current output voltage (OVDD) for driving.

However, in a large scale AMOLED display device, a certain resistance unavoidably exists for a backplate power supply signal line. The driving current for all the pixels are provided by the OVDD. The power supply voltage in the area close to the OVDD power supplying position is higher than the power supply voltage in the area away from the power supplying position. The phenomenon is named power supply voltage drop (IR Drop). Because the voltage and the current of the OVDD are related. The IR Drop can cause the current difference among different areas which the uneven brightness (mura) phenomenon can happen thereby as displaying.

For now, the compensation method of AMOLED has internal compensation and external compensation. The internal compensation of the AMOLED is to compensate the threshold voltage (Vth) of the TFT or the channel mobility (μ) but not the IR drop; the external compensation can be optical compensation and electrical compensation. The electrical compensation can merely compensate the threshold voltages of the driving TFT and the OLED but not the IR Drop. The optical compensation can compensate the IR Drop but the compensation in time cannot be achievable.

SUMMARY OF THE INVENTION

An objective of the present invention is to provide a method of compensating AMOLED power supply voltage drop to solve the issue of uneven brightness caused by IR Drop in a large scale AMOLED display device.

For realizing the aforesaid objective, the present invention provides a method of compensating AMOLED power supply voltage drop, comprising steps of:

step 1, measuring a brightness value L of each light-emitting element line of a panel by starting from a COF end of the AMOLED;

step 2, drawing a brightness variation curve of the each light-emitting element line caused by IR Drop according to the brightness value L of the each light-emitting element line measured in the step 1;

step 3, calculating a voltage value for compensation of every two adjacent light-emitting elements from difference values between the brightnesses of every two adjacent light-emitting elements according to a ratio conversion between a brightness difference ΔL and a voltage difference ΔV, i.e. $\Delta V=\alpha\cdot\Delta L$, wherein α is a scaling factor;

a voltage value for compensation required for a second light-emitting element line relative to a first light-emitting element line is a first compensation value $\Delta V_1$, and a voltage value for compensation required for a third light-emitting element line relative to the second light-emitting element line is a second compensation value $\Delta V_2$, and so on to a last light-emitting element line;

step 4, making no compensation to a data voltage of the first light-emitting element line, and adding the first compensation value $\Delta V_1$ to a data voltage of the second light-emitting element line, and adding a sum $(\Delta V_1+\Delta V_2)$ of the first and the second compensation value to a data voltage of a third light-emitting element line and so on to the last light-emitting element line when a sequence controller transmits data voltage signals for showing images.

In the brightness variation curve of the step 2, the measured brightness value of the each light-emitting element line gets lower and lower when the line number of the light-emitting element increases.

A calculation employed in the step 3 is:

$$\Delta V_{n-1}=\alpha\cdot\Delta L_{n-1}=\alpha\cdot(L_n-L_{n-1})$$

$\Delta V_{n-1}$ is an n−1th voltage value for compensating an nth and an n−1th light-emitting element lines, and $\Delta L_{n-1}$ is a brightness difference value of a brightness $L_n$ of the nth light-emitting element line and a brightness $L_{n-1}$ of the n−1th light-emitting element line, and n is a positive integer larger than 1.

A calculation employed in the step 4 is:

$$\begin{cases} V_1 = V_{data} \\ V_n = V_{data} + \sum_{i=2}^{n} \Delta V_{i-1} \end{cases}$$

$V_n$ represents an ultimately required voltage for the nth light-emitting element line, and $V_{data}$ represents the data voltage, and n is a positive integer larger than 1.

The voltage value for compensation is directly added on the data voltage without an additional compensation circuit.

The voltage value for compensation of every two adjacent light-emitting elements obtained in the step 3 is stored in a memory unit.

The method of compensating AMOLED power supply voltage drop is applied to an OVDD single drive AMOLED display device or an OVDD double drive AMOLED display device. The benefits of the present invention are: the present invention provides a method of compensating AMOLED power supply voltage drop to convert the brightness difference value caused by IR Drop into the voltage difference value, and to perform corresponding voltage compensation to the each light-emitting element line to solve the issue of uneven brightness caused by IR Drop in a large scale AMOLED display device. The calculation is not complex and additional circuit is not demanded which can diminish the circuit area and increase the aperture ratio.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to limit the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
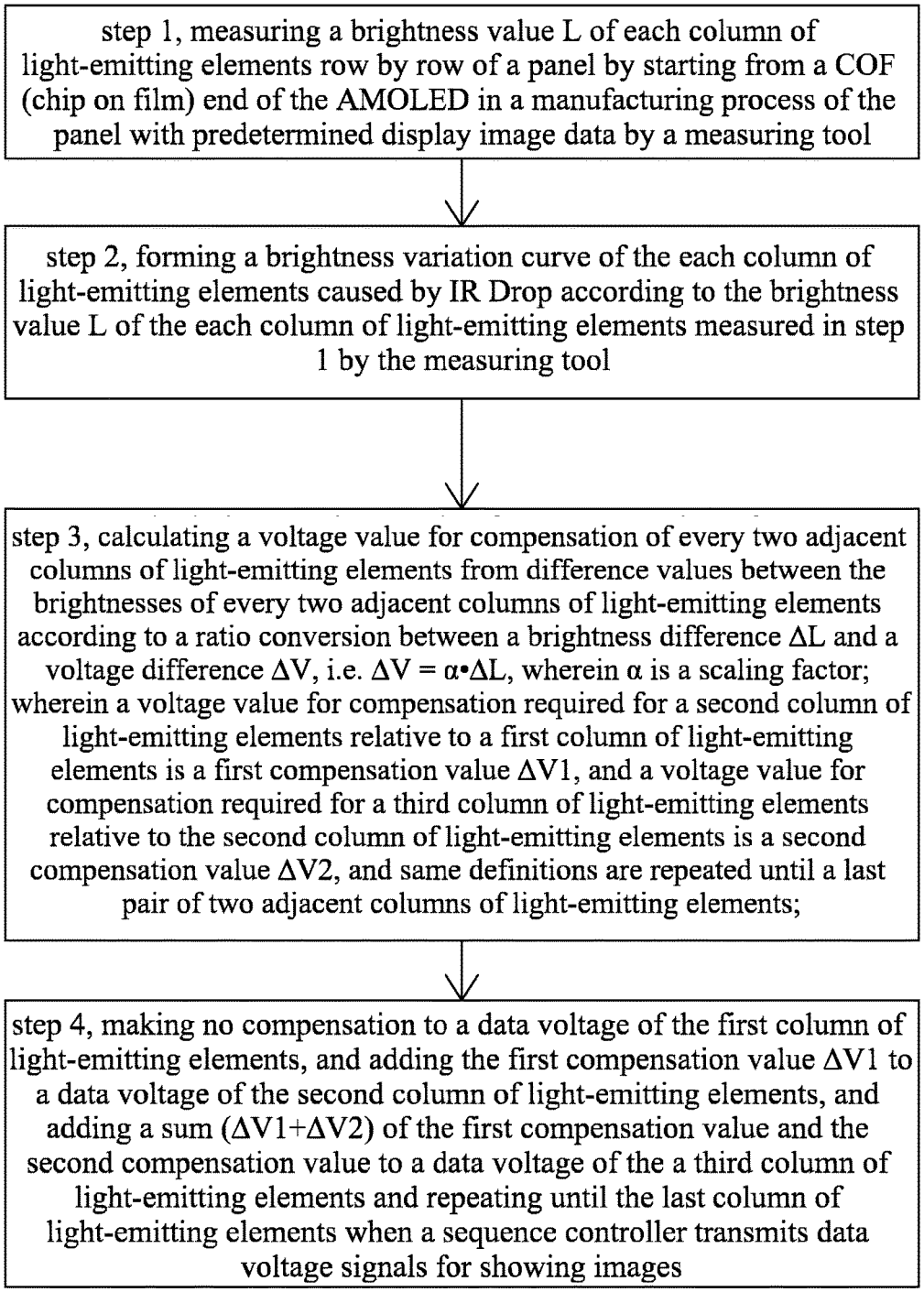
FIG. 1 is a flowchart of a method of compensating AMOLED power supply voltage drop according to the present invention.

Please refer to FIG. 1. The present invention provides a method of compensating AMOLED power supply voltage drop, comprising steps of:

step 1, measuring a brightness value L of each light-emitting element line of a panel by starting from a Chip On Film (COF) end of the AMOLED.

Figure 2:
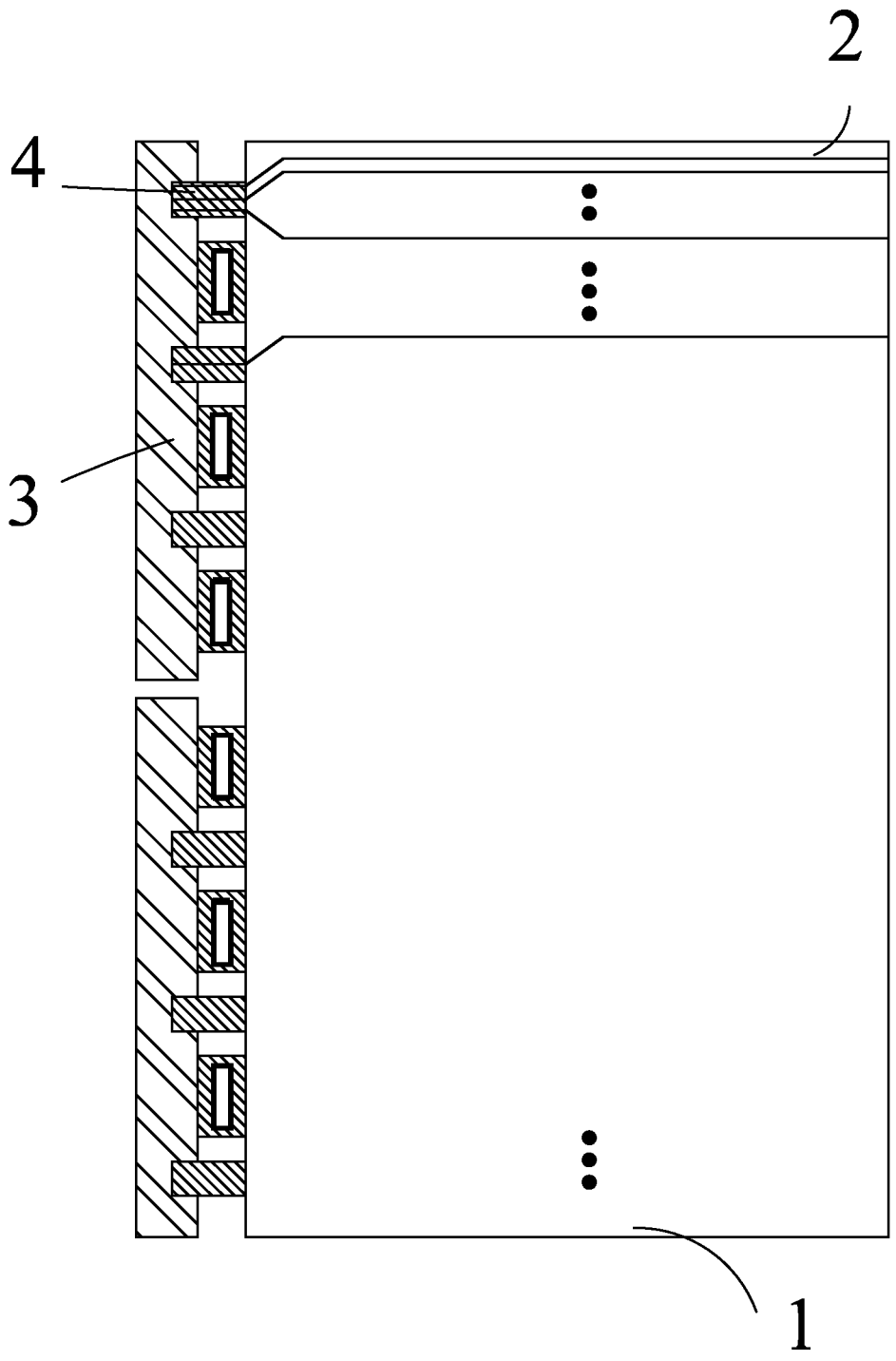
FIG. 2 is a diagram of an OVDD single drive AMOLED display device applied with the method of compensating AMOLED power supply voltage drop according to the present invention.

FIG. 2 is a diagram of an OVDD single drive AMOLED display device applied with the method of compensating AMOLED power supply voltage drop according to the present invention. The OVDD single drive AMOLED display device comprises a display panel 1, an OVDD power supply line 2, an X board 3 and a COF end 4. In combination with FIG. 2, as performing the step 1 of measuring a brightness value L of each light-emitting element line of a panel, the measurement starts from the COF end 4 along the wiring direction of the OVDD power supply line 2 from left to right, the brightness value of each light-emitting element line is measured sequentially.

step 2, drawing a brightness variation curve of the each light-emitting element line caused by IR Drop according to the brightness value L of the each light-emitting element line measured in the step 1.

Figure 3:
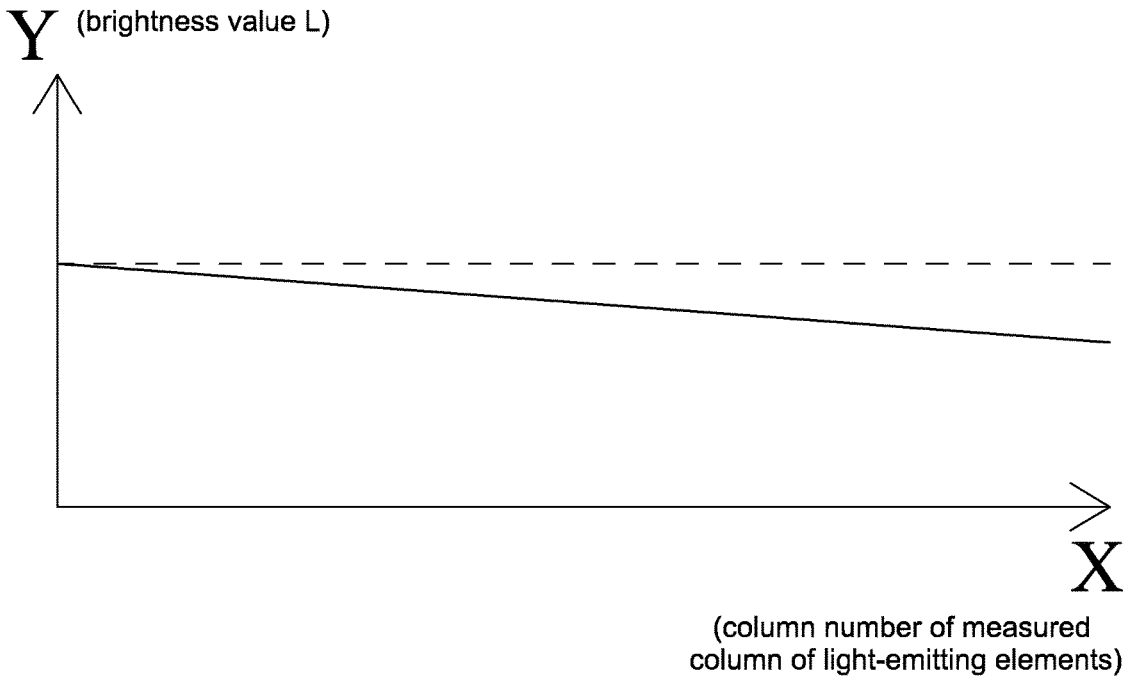
FIG. 3 is a brightness variation curve of the OVDD single drive AMOLED display device shown in FIG. 2.

FIG. 3 is a brightness variation curve of the OVDD single drive AMOLED display device shown in FIG. 2. The X axis is the line number of the measured light-emitting element. The Y axis is the brightness value L. As shown in FIG. 3, along with the increasing line number of the light-emitting element, the OVDD power supply line 2 gets longer. With the influence of IR Drop, the measured brightness value of the each light-emitting element line gets lower and lower.

step 3, calculating a voltage value for compensation of every two adjacent light-emitting elements from difference values between the brightnesses of every two adjacent light-emitting elements according to a ratio conversion between a brightness difference $\Delta L$ and a voltage difference $\Delta V$, i.e. $\Delta V=\alpha\cdot\Delta L$, wherein $\alpha$ is a scaling factor.

Specifically, a voltage value for compensation required for a second light-emitting element line relative to a first light-emitting element line is a first compensation value $\Delta V_1$, and a voltage value for compensation required for a third light-emitting element line relative to the second light-emitting element line is a second compensation value $\Delta V_2$, and so on to a last light-emitting element line.

which is: $\Delta V_{n-1}=\alpha\cdot\Delta L_{n-1}=\alpha\cdot(L_n-L_{n-1})$ $\Delta V_{n-1}$ is an n−1th voltage value for compensating an nth and an n−1th light-emitting element lines, and $\Delta L_{n-1}$ is a brightness difference value of a brightness $L_n$ of the nth light-emitting element line and a brightness $L_{n-1}$ of the n−1th light-emitting element line, and n is a positive integer larger than 1.

The voltage value for compensation of every two adjacent light-emitting elements obtained in the step 3 is stored in a memory unit.

step 4, making no compensation to a data voltage of the first light-emitting element line, and adding the first compensation value $\Delta V_1$ to a data voltage of the second light-emitting element line, and adding a sum $(\Delta V_1+\Delta V_2)$ of the first and the second compensation value to a data voltage of a third light-emitting element line and so on to the last light-emitting element line when a sequence controller transmits data voltage signals for showing images.

which is:

$$\begin{cases} V_1 = V_{data} \\ V_n = V_{data} + \sum_{i=2}^{n} \Delta V_{i-1} \end{cases}$$

$V_n$ represents an ultimately required voltage for the nth light-emitting element line, and $V_{data}$ represents the data voltage, and n is a positive integer larger than 1.

In the step 4, the voltage compensation to each light-emitting element is directly added on the data voltage without an additional compensation circuit. Accordingly, the circuit area can be diminished and the aperture ratio can be increased.

With the four steps to perform voltage compensation to each light-emitting element, the AMOLED power supply voltage drop can be effectively compensated to solve the issue of uneven brightness caused by IR Drop in a large scale AMOLED display device.

Figure 4:
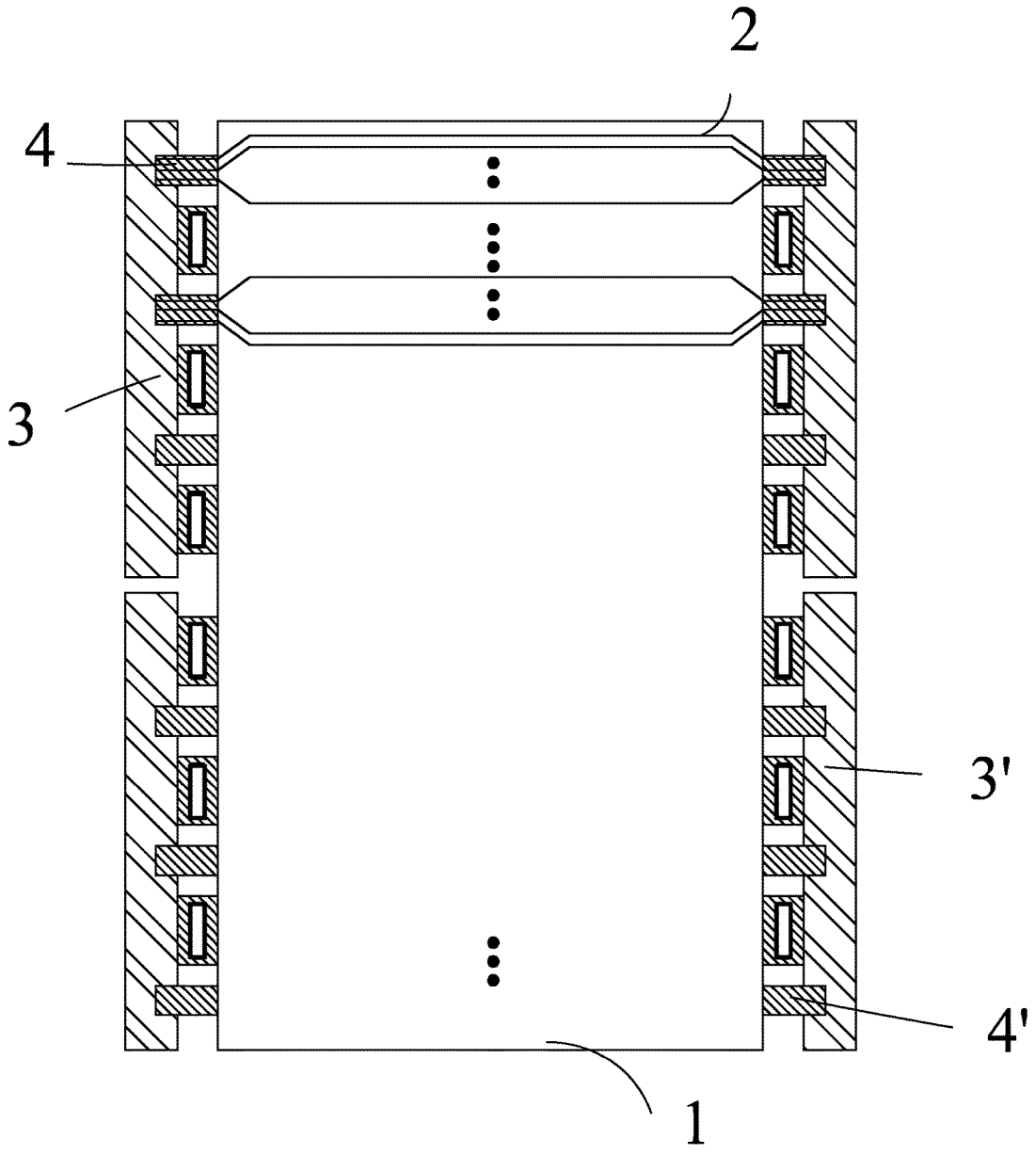
FIG. 4 is a diagram of an OVDD double drive AMOLED display device applied with the method of compensating AMOLED power supply voltage drop according to the present invention.

FIG. 4 is a diagram of an OVDD double drive AMOLED display device applied with the method of compensating AMOLED power supply voltage drop according to the present invention. Compared with the OVDD single drive AMOLED display device shown in FIG. 2, the OVDD double drive AMOLED display device further comprises a second X board 3' and a second COF end 4' to implement the double scan drive. The X board 3 and the COF end 4 are served in a forward driving. The aforesaid step 1 is performed from left to right to measure the brightness value of the each light-emitting element line. The line number of the measured light-emitting element increases from left to right;

the X board 3' and the COF end 4' are served in a backward driving. The aforesaid step 1 is performed from right to left to measure the brightness value of the each light-emitting element line. The line number of the measured light-emitting element increases from right to left. The rest steps remain the same. The repeated description is omitted here.

In conclusion, the present invention provides a method of compensating AMOLED power supply voltage drop to convert the brightness difference value caused by IR Drop into the voltage difference value, and to perform corresponding voltage compensation to the each light-emitting element line to solve the issue of uneven brightness caused by IR Drop in a large scale AMOLED display device. The calculation is not complex and additional circuit is not demanded which can diminish the circuit area and increase the aperture ratio.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A method of compensating AMOLED (active matrix organic light emitting diode) power supply voltage drop, comprising steps of:

step 1, measuring a brightness value L of each column of light-emitting elements row by row of a panel by starting from a COF (chip on film) end of the AMOLED;

step 2, forming a brightness variation curve of the each column of light-emitting elements caused by IR Drop according to the brightness value L of the each column of light-emitting elements measured in step 1;

step 3, calculating a voltage value for compensation of every two adjacent columns of light-emitting elements from difference values between the brightnesses of every two adjacent columns of light-emitting elements according to a ratio conversion between a brightness difference $\Delta L$ and a voltage difference $\Delta V$, i.e. $\Delta V=\alpha\cdot\Delta L$, wherein $\alpha$ is a scaling factor;

wherein a voltage value for compensation required for a second column of light-emitting elements relative to a first column of light-emitting elements is a first compensation value $\Delta V_1$, and a voltage value for compensation required for a third column of light-emitting elements relative to the second column of light-emitting elements is a second compensation value $\Delta V_2$, and same definitions are repeated until a last pair of two adjacent columns of light-emitting elements;

step 4, making no compensation to a data voltage of the first column of light-emitting elements, and adding the first compensation value $\Delta V_1$ to a data voltage of the second column of light-emitting elements, and adding a sum $(\Delta V_1+\Delta V_2)$ of the first compensation value and the second compensation value to a data voltage of the third column of light-emitting elements and repeating until the last column of light-emitting elements when a sequence controller transmits data voltage signals for showing images.

2. The method of compensating AMOLED power supply voltage drop according to claim 1, wherein in the brightness variation curve of step 2, the measured brightness value of the each column of light-emitting elements decreases when a column number of the column of light-emitting elements increases.

3. The method of compensating AMOLED power supply voltage drop according to claim 2, wherein a calculation employed in step 4 is:

$$\begin{cases} V_1 = V_{data} \\ V_n = V_{data} + \sum_{i=2}^{n} \Delta V_{i-1} \end{cases}$$

$V_n$ represents an ultimately required voltage for the nth column of light-emitting elements, and $V_{data}$ represents the data voltage, and n is a positive integer larger than 1.

4. The method of compensating AMOLED power supply voltage drop according to claim 1, wherein a calculation employed in step 3 is:

$$\Delta V_{n-1}=\alpha\cdot\Delta L_{n-1}=\alpha\cdot(L_n-L_{n-1})$$

$\alpha V_{n-1}$ is an n−1th voltage value for compensating an nth and an n−1th light-emitting element lines, and $\Delta L_{n-1}$ is a brightness difference value of a brightness $L_n$ of the nth column of light-emitting elements and a brightness $L_{n-1}$ of the n−1th column of light-emitting elements, and n is a positive integer larger than 1.

5. The method of compensating AMOLED power supply voltage drop according to claim 1, wherein the voltage value for compensation is directly added on the data voltage without a compensation circuit.

6. The method of compensating AMOLED power supply voltage drop according to claim 1, wherein the voltage value for compensation of every two adjacent columns of light-emitting elements obtained in step 3 is stored in a memory unit.

7. A method of compensating AMOLED (active matrix organic light emitting diode) power supply voltage drop, comprising steps of:

step 1, measuring a brightness value L of each column of light-emitting elements row by row of a panel by starting from a COF (chip on film) end of the AMOLED;

step 2, forming a brightness variation curve of the each column of light-emitting elements caused by IR Drop according to the brightness value L of the each column of light-emitting elements measured in step 1;

step 3, calculating a voltage value for compensation of every two adjacent columns of light-emitting elements from difference values between the brightnesses of every two adjacent columns of light-emitting elements according to a ratio conversion between a brightness difference $\Delta L$ and a voltage difference $\Delta V$, i.e. $\Delta V=\alpha\cdot\Delta L$, wherein $\alpha$ is a scaling factor;

wherein a voltage value for compensation required for a second column of light-emitting elements relative to a first column of light-emitting elements is a first compensation value $\Delta V_1$, and a voltage value for compensation required for a third column of light-emitting elements relative to the second column of light-emitting elements is a second compensation value $\Delta V_2$, and same definitions are repeated until a last pair of two adjacent columns of light-emitting elements;

step 4, making no compensation to a data voltage of the first column of light-emitting elements, and adding the first compensation value $\Delta V_1$ to a data voltage of the second column of light-emitting elements, and adding a sum $(\Delta V_1+\Delta V_2)$ of the first compensation value and the second compensation value to a data voltage of the third column of light-emitting elements and repeating until the last column of light-emitting elements when a sequence controller transmits data voltage signals for showing images;

in the brightness variation curve of step 2, the measured brightness value of the each column of light-emitting elements decreases when a column number of the light-emitting elements increases;

wherein a calculation employed in step 3 is:

$$\Delta V_{n-1}=\alpha\cdot\Delta L_{n-1}=\alpha\cdot(L_n-L_{n-1})$$

$\Delta V_{n-1}$ is an n−1th voltage value for compensating an nth and an n−1th light-emitting element lines, and $\Delta L_{n-1}$ is a brightness difference value of a brightness $L_n$ of the nth column of light-emitting elements and a brightness $L_{n-1}$ of the n−1th column of light-emitting elements, and n is a positive integer larger than 1;

wherein a calculation employed in step 4 is:

$$\begin{cases} V_1 = V_{data} \\ V_n = V_{data} + \sum_{i=2}^{n} \Delta V_{i-1} \end{cases}$$

$V_n$ represents a ultimately required voltage for the nth column of light-emitting elements, and $V_{data}$ represents the data voltage, and n is a positive integer larger than 1.

8. The method of compensating AMOLED power supply voltage drop according to claim 7, wherein the voltage value for compensation is directly added on the data voltage without a compensation circuit.

9. The method of compensating AMOLED power supply voltage drop according to claim 7, wherein the voltage value for compensation of every two adjacent columns of light-emitting elements obtained in step 3 is stored in a memory unit.

* * * * *